US009717388B2

(12) United States Patent
Jeong et al.

(10) Patent No.: US 9,717,388 B2
(45) Date of Patent: Aug. 1, 2017

(54) PAD CHANGER, CLEANER AND CLEANER SYSTEM HAVING THE SAME

(71) Applicant: SAMSUNG ELECTRONICS CO., LTD., Suwon-si, Gyeonggi-do (KR)

(72) Inventors: Jae Youl Jeong, Suwon-si (KR); Dong Hun Lee, Ansan-si (KR); Min Jae Kim, Seongnam-si (KR); Heum Yong Park, Suwon-si (KR); Dong Hyun Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 162 days.

(21) Appl. No.: 14/575,076

(22) Filed: Dec. 18, 2014

(65) Prior Publication Data

US 2015/0182089 A1 Jul. 2, 2015

(30) Foreign Application Priority Data

Dec. 30, 2013 (KR) ..... 10-2013-0167184

(51) Int. Cl.
*A47L 11/28* (2006.01)
*A47L 11/40* (2006.01)

(52) U.S. Cl.
CPC ..... *A47L 11/4036* (2013.01); *A47L 11/28* (2013.01); *A47L 11/4038* (2013.01); *A47L 2201/02* (2013.01); *Y10T 483/1845* (2015.01)

(58) Field of Classification Search
CPC .. A47L 11/282; A47L 11/283; A47L 11/4038; A47L 11/134; A47L 2201/028; A47L 11/28; G05D 1/0225
See application file for complete search history.

(56) References Cited

U.S. PATENT DOCUMENTS 5,439,413 A * 8/1995 Lagler ..... A47L 11/162 451/353
5,959,423 A 9/1999 Nakanishi et al.
6,871,371 B2 * 3/2005 Guest ..... A47L 11/16 15/49.1
2006/0060216 A1 3/2006 Woo

FOREIGN PATENT DOCUMENTS

DE 10 2010 017 211 A1 12/2011
KR 10-2008-0091042 10/2008
WO WO 01/82766 A2 11/2001

OTHER PUBLICATIONS

English translation of DE 10 2010 017 211 A1, Meyer, published Dec. 8, 2011.*
Extended European Search Report dated Jun. 23, 2015 in corresponding European Application No. 14198612.5.
Dong Hun Shin et al., "Motion Analysis of Omni-directional Self-propulsive Polishing Robot", Journal of the Korean Society of Precision Engineering, vol. 16, No. 5, May 1999, pp. 151-159.

* cited by examiner

*Primary Examiner* — Laura C Guidotti
(74) *Attorney, Agent, or Firm* — Staas & Halsey LLP

(57) ABSTRACT

A pad changer capable of automatically replacing a pad used to wipe out dust on a floor, a cleaner and a cleaner system having the pad changer are provided. The pad changer to replace a pad mounted to a cleaner includes a replacement unit. The replacement unit includes a separation cartridge to separate the pad from the cleaner and receive the separated pad therein, and a mounting cartridge to receive a pad therein and mount the pad to the cleaner.

19 Claims, 24 Drawing Sheets

PAD CHANGER, CLEANER AND CLEANER SYSTEM HAVING THE SAME

CROSS-REFERENCE TO RELATED APPLICATIONS

This application is related to, and claims the priority benefit of, Korean Patent Application No. 10-2013-0167184, filed on Dec. 30, 2013 in the Korean Intellectual Property Office, the disclosure of which is incorporated herein by reference.

BACKGROUND

1. Field

Embodiments relate to a pad changer by which pads are changed, and a cleaner and the cleaner system having the same.

2. Description of the Related Art

A robot cleaner is a self-motive appliance utilizing an automatic travel function to clean a room or the like by vacuuming foreign materials, such as dust, from a floor of a room without user intervention. The robot cleaner detects a distance to an obstacle, such as furniture, office supplies, walls or the like, present in a zone to be cleaned using a distance sensor, and changes traveling directions by selectively driving a left-wheel motor and a right-wheel motor to perform cleaning of the zone to be cleaned.

Besides robot cleaners capable of vacuuming foreign materials, such as dust, from a floor, robot cleaners capable of wiping floors have been developed recently. A conventional robot cleaner may be structured such that a pad may be removably attached to a bottom surface thereof using Velcro or the like. When a pad needs to be replaced because of contamination, a user turns a robot cleaner over, or stands a robot cleaner up, to remove the contaminated pad and attach a new pad.

SUMMARY

It is an aspect to provide a pad changer capable of automatically replacing a pad used to wipe dust on a floor, a cleaner and a cleaner system having the pad changer.

Additional aspects of the invention will be set forth in part in the description which follows and, in part, will be obvious from the description, or may be learned by practice of the invention.

In accordance with an aspect of an exemplary embodiment, a pad changer to replace a pad mounted to a cleaner is provided. The pad changer includes a replacement unit including a separation cartridge to separate the pad from the cleaner and receive the separated pad therein and a mounting cartridge to receive a pad therein and mount the pad to the cleaner.

The separation cartridge may include a pad separation device configured to move up and down in the separation cartridge and separate the pad from the cleaner.

The mounting cartridge may include a mounting plate on which the pad is seated and which is configured to move up and down in the mounting cartridge.

The pad changer may include a case. The replacement unit may include a base configured to rotate with respect to the case, on which the separation cartridge and the mounting cartridge are seated.

The case may be formed with an opening at a portion thereof, through which the separation cartridge and the mounting cartridge are inserted into the case.

The separation cartridge may be seated on a separation holder to be inserted into the case, and the mounting cartridge may be seated on a mounting holder to be inserted into the case.

The opening of the case may be provided with a guide protrusion at an inner side surface thereof, and the separation cartridge or the mounting cartridge may be formed with a guide recess which extends in a forward and backward direction and into which the guide protrusion is inserted.

The pad changer may include a plate unit on which the cleaner is seated and which is configured to move between the front of the case and a portion of the case corresponding to a position of the replacement unit.

The plate unit may include a frame, a first plate, a second plate and a third plate. The first plate, the second plate and the third plate may be connected to the frame.

The frame may be provided with fixing protrusions to support the cleaner.

The case may be provided with a rack gear, and the plate unit may be provided with a pinion gear tooth-engaged with the rack gear.

The pad changer may include a connection unit which is connected to the third plate and is formed with a guide slot into which a rotating shaft of the pinion gear is inserted.

The guide slot may be formed in a gradual curve.

In accordance with an aspect of an exemplary embodiment, a cleaner system is provided including a cleaner having a pad assembly and a pad changer to replace a pad mounted to the pad assembly. The pad assembly includes a pad unit and a locking member to which the pad unit is coupled, and the pad changer includes a replacement unit including a separation cartridge to separate the pad unit from the locking member and receive the separated pad unit therein and a mounting cartridge to receive a pad unit therein and mount the pad unit to the locking member.

The pad unit may include a pad and a pad mounting part. The pad may be removably mounted to a bottom surface of the pad mounting part. The pad mounting part may be provided with locking protrusions which have locking parts formed at tops thereof.

The pad assembly may include locking member accommodation parts to accommodate the locking member therein, and the locking member may have free ends, by which the locking member is elastically deformed.

The locking member and the locking member accommodation parts may be formed with locking holes through which the locking protrusions are inserted, and the locking holes of the locking member accommodation parts may partially interfere with the locking member.

The separation cartridge may include a separation device configured to move up and down in the separation cartridge, and the separation device may push the locking member upward to release interference of the locking protrusions with the locking member.

The mounting cartridge may include a mounting plate on which the pad unit is seated and which is configured to move up and down in the mounting cartridge, and the mounting plate may move upward so that the locking protrusions of the pad unit interfere with the locking member, thereby mounting the pad unit to the locking member.

The pad changer may include a plate unit to support the cleaner above the replacement unit.

The cleaner may be provided with guide protruding parts at side surfaces thereof, and the plate unit may be provided with fixing protrusions to support the guide protruding parts of the cleaner.

The pad changer may include a case to receive the replacement unit therein, and the plate unit may be configured to move between the front of the case and a portion of the case corresponding to a position of the replacement unit.

In accordance with an aspect of the present invention, a cleaner is provided including a pad assembly which includes a pad unit and a locking member to which the pad unit is coupled. The pad unit includes a pad and a pad mounting part to which the pad is removably mounted. The pad mounting part is provided with locking protrusions which have locking parts formed at tops thereof.

The pad assembly may include locking member accommodation parts to accommodate the locking member therein, and the locking member may have free ends, by which the locking member is elastically deformed.

The locking member and the locking member accommodation parts may be formed with locking holes through which the locking protrusions are inserted, and the locking holes of the locking member accommodation parts may partially interfere with the locking member.

As is apparent from the above description, since a contaminated pad may be automatically replaced by a new pad, pad replacement becomes convenient and cleaning efficiency is enhanced due to the newly attached pad cleaning a floor.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
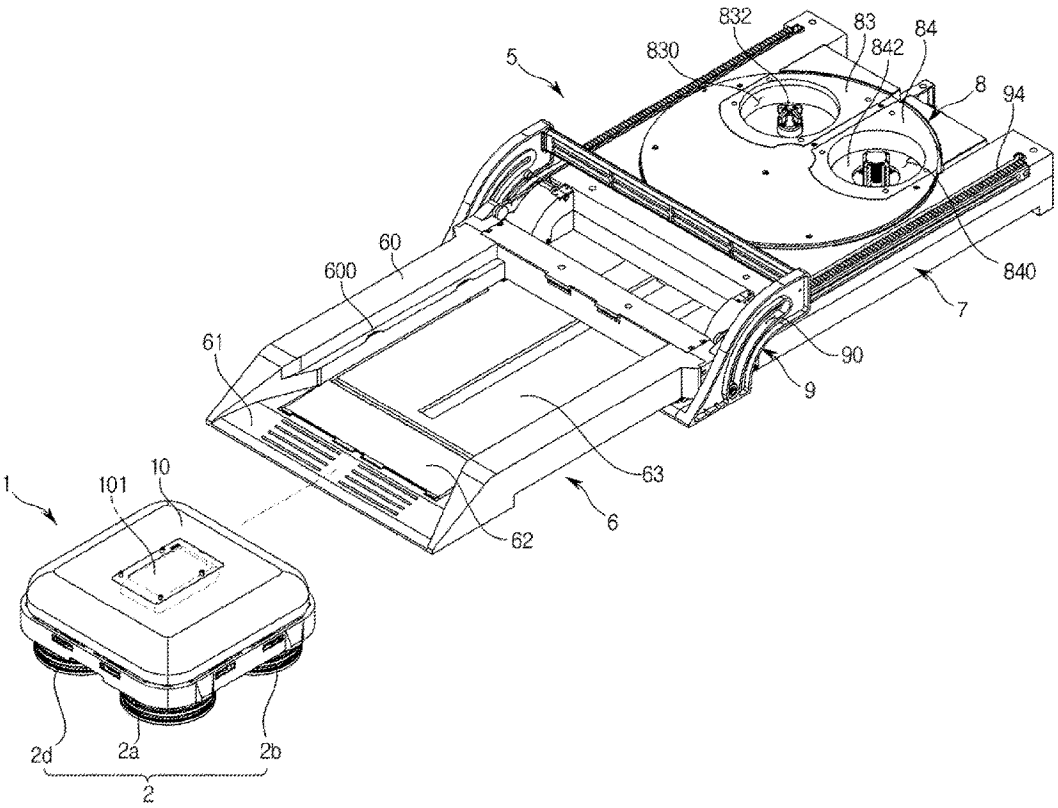
FIG. 1 is a view illustrating a robot cleaner system according to an exemplary embodiment.

Reference will now be made in detail to the embodiments, examples of which are illustrated in the accompanying drawings, wherein like reference numerals refer to like elements throughout.

FIG. 1 is a view illustrating a robot cleaner system according to an exemplary embodiment.

Referring to FIG. 1, a robot cleaner system according to an exemplary embodiment comprises a robot cleaner 1 and a pad changer 5. The robot cleaner 1 includes a pad assembly 2. A cover 10 is provided at a top surface of the robot cleaner 1. A bumper 11 may be provided at a side surface of the robot cleaner 1. The cover 10 may be provided with a water tank accommodation part 100. A water tank 101 to supply water to the pad assembly 2 may be accommodated in the water tank accommodation part 100. The water tank 101 and the pad assembly 2 may be connected by a tube (not illustrated). The pad assembly 2 may be configured to wet clean a floor using water supplied from the water tank 101. The water supply from the water tank 101 to the pad assembly 2 may be mechanically and/or electronically controlled. When the robot cleaner moves to the pad changer 5 for pad replacement, the water supply may be interrupted.

The pad assembly 2 may include a first pad assembly 2*a*, a second pad assembly 2*b*, a third pad assembly 2*c* and a fourth pad assembly 2*d*. The first pad assembly 2*a*, the second pad assembly 2*b*, the third pad assembly 2*c* and the fourth pad assembly 2*d* are configured to scrub a floor by rotating by a driving source.

A pad to scrub a floor may be provided at a bottom surface of the pad assembly 2. In other words, a pad to scrub a floor may be attached to a bottom surface of each of the first pad assembly 2*a*, the second pad assembly 2*b*, the third pad assembly 2*c* and the fourth pad assembly 2*d*.

A contaminated pad may be replaced by a new pad by the pad changer 5. After the robot cleaner 1 travels on a floor and scrubs a floor for a predetermined time, the robot cleaner 1 may move to the pad changer 5. The pad changer 5 replaces the contaminated pad with a new pad. The robot cleaner 1 with the new pad exits from the pad changer 5 and scrubs a floor again.

The pad changer 5 includes a plate unit 6, a case 7 and a replacement unit 8. The replacement unit 8 may be received in the case 7. The plate unit 6 may be connected to the case 7 by a connection unit 9. The plate unit 6 may be positioned on the case 7. If there is a need to replace a contaminated pad, the plate unit 6, for example, may slide to the front of the case 7. The robot cleaner 1 may be seated on the plate unit 6. The plate unit 6 may slide, for example, to the top of the case 7. A bottom surface of the robot cleaner 1 may be positioned on the replacement unit 8. The replacement unit 8 separates a contaminated pad from the bottom surface of the robot cleaner 1 and replaces the same with a new pad.

Figure 2:
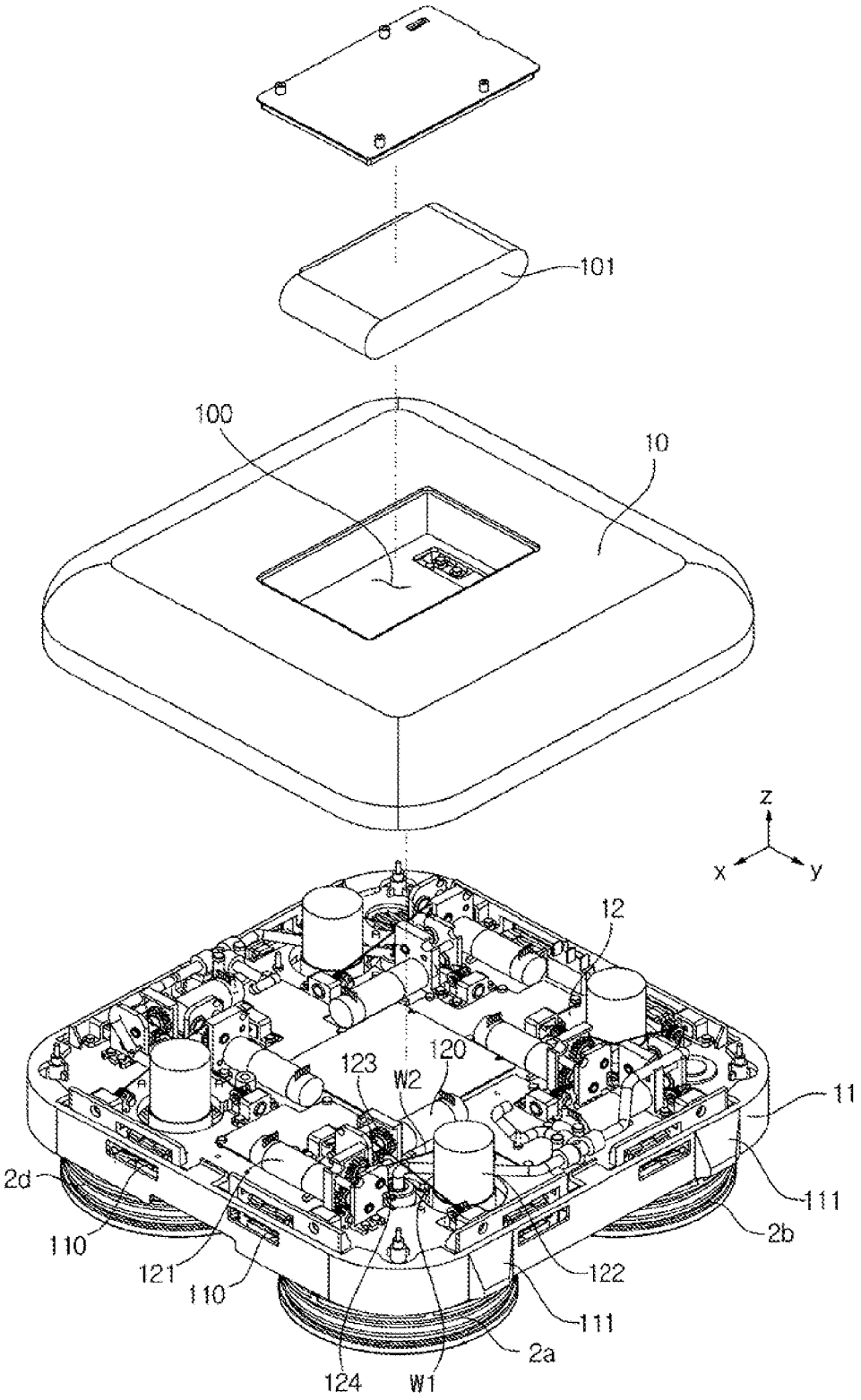
FIG. 2 is a view illustrating a robot cleaner according to an exemplary embodiment with a cover removed therefrom.

FIG. 2 is a view illustrating the robot cleaner according to the exemplary embodiment with the cover removed therefrom.

Referring to FIG. 2, the robot cleaner 1 may include a pad assembly 2 to wipe a floor, and a base 12 provided with bumpers 11 and driving sources. The pad assembly 2 may include a first pad assembly 2*a*, a second pad assembly 2*b*, a third pad assembly 2*c* and a fourth pad assembly 2*d*.

Sensors 110 may be provided at a portion of the bumper 11. The sensors 110 may be configured to interact with sensors 640 provided at the pad changer 5 so that the robot cleaner 1 is seated on the plate unit 6 of the pad changer 5.

Guide protruding parts 111 may be provided at the other portion of the bumpers 11. A recess (not illustrated) may be formed at a bottom surface of each guide protruding part 111. The guide protruding parts 111 may be supported by fixing protrusions 600 provided at the pad changer 5. In a case in which a recess is formed at the bottom surface of each guide protruding part 111, each fixing protrusion 600 may be inserted into the recess. Accordingly, the robot cleaner 1 may be fixedly seated on the plate unit 6 of the pad changer 5.

Since the first pad assembly 2*a*, the second pad assembly 2*b*, the third pad assembly 2*c* and the fourth pad assembly 2*d* are similar and the driving units to drive the first through fourth pad assemblies are similar, only the first pad assembly 2*a* is explained hereinafter.

The robot cleaner 1 may include a first motor 120, a second motor 121 and a third motor 122 that are the driving sources. The first motor 120 and the second motor 121 may be provided at the base 12. The third motor 122 may be mounted to the first pad assembly 2*a*. The first pad assembly 2*a* rotates and scrubs a floor by the third motor 122.

A first shaft 123 may be connected to the first motor 120. The first shaft 123 may rotate by the first motor 120. A first wire W1 may be connected to the first shaft 123. If the first shaft 123 rotates clockwise or counterclockwise by the first motor 120, the first wire W1 may be wound on the first shaft 123. One end portion or the other end portion of the first wire W1 may be fixed to the first pad assembly 2*a*. If the first wire W1 is wound on the first shaft 123 by rotation of the first shaft 123, the first pad assembly 2*a* may tilt by the first wire W1. For example, if the first wire W1 is wound on the first shaft 123 by rotation of the first shaft 123, the first pad assembly 2*a* may tilt about an x-axis by the first wire W1. If the first pad assembly 2*a* tilts, when the first pad assembly 2*a* rotates about a z-axis by the third motor 122, non-uniform frictional force may be generated between the bottom surface of the first pad assembly 2*a* and a floor.

A second shaft 124 may be connected to the second motor 121. The second shaft 124 may rotate by the second motor 121. A second wire W2 may be connected to the second shaft 124. If the second shaft 124 rotates clockwise or counterclockwise by the second motor 121, the second wire W2 may be wound on the second shaft 124. One end portion or the other end portion of the second wire W2 may be fixed to the first pad assembly 2*a*. If the second wire W2 is wound on the second shaft 124 by rotation of the second shaft 124, the first pad assembly 2*a* may tilt by the second wire W2. For example, if the second wire W2 is wound on the second shaft 124 by rotation of the second shaft 124, the first pad assembly 2*a* may tilt about a y-axis by the second wire W2. If the first pad assembly 2*a* tilts, when the first pad assembly 2*a* rotates about the z-axis by the third motor 122, non-uniform frictional force may be generated between the bottom surface of the first pad assembly 2*a* and a floor.

The first pad assembly 2*a* may scrub a floor by tilting by the first motor 120 or the second motor 121 and rotating clockwise or counterclockwise by the third motor 122. The second pad assembly 2*b*, the third pad assembly 2*c* and the fourth pad assembly 2*d*, similar to the first pad assembly 2*a*, may also scrub a floor by tilting about the x-axis and the y-axis by the first motor or the second motor and rotating clockwise or counterclockwise by the third motor. The robot cleaner 1 may travel in a specific direction by non-uniform frictional force between the pad assembly 2 and a floor.

The robot cleaner 1 may travel in a direction in which the frictional force between the bottom surface of the pad assembly 2 and a floor is large. A traveling speed of the robot cleaner 1 may be changed by a rotational speed of the third motor 122.

Figure 3:
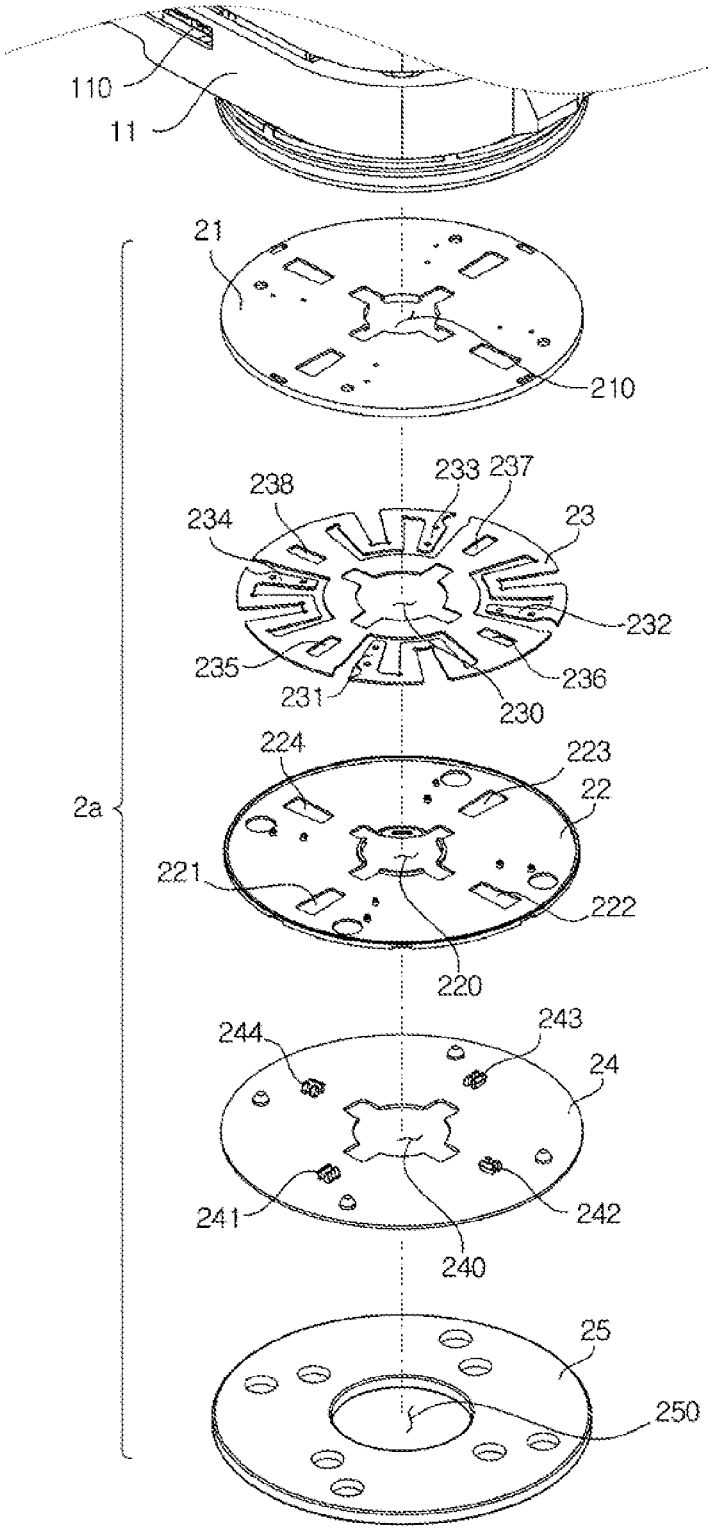
FIG. 3 is an exploded perspective view illustrating a pad assembly of the robot cleaner according to an exemplary embodiment.
Figure 4:
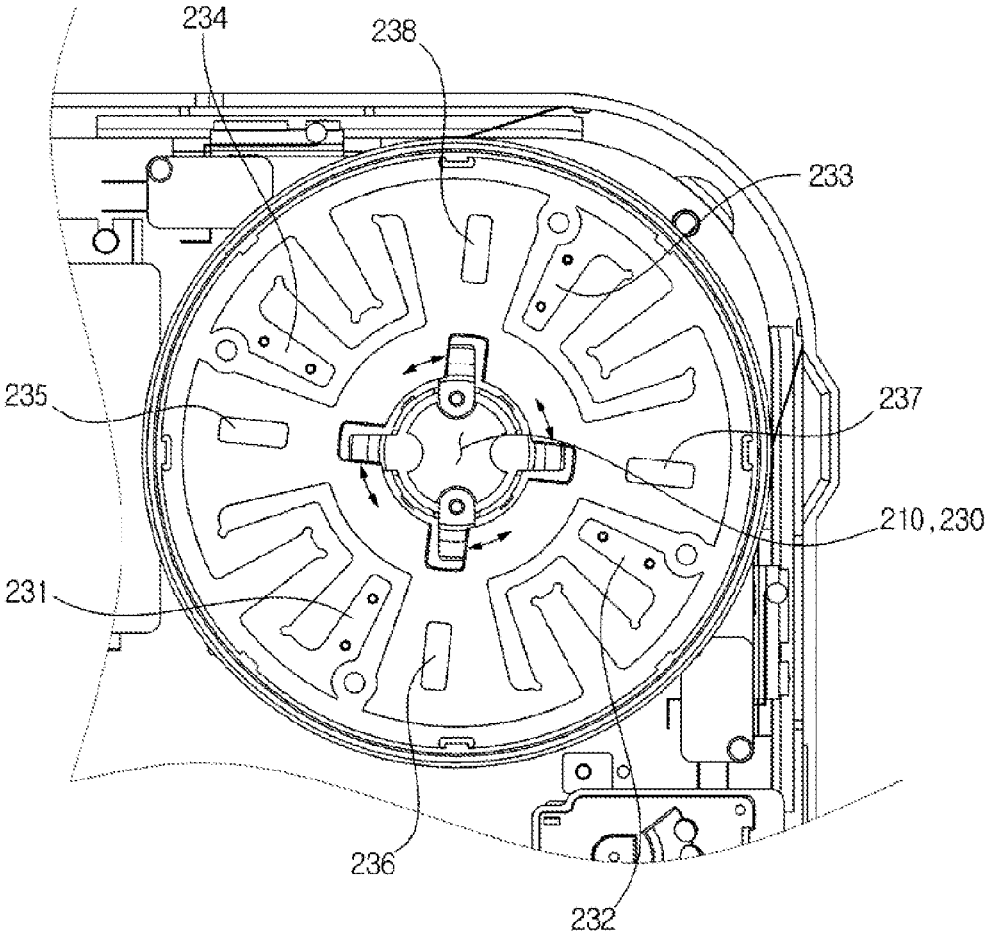
FIG. 4 is a view illustrating a part of the pad assembly of the robot cleaner according to an exemplary embodiment.

FIG. 3 is an exploded perspective view illustrating the pad assembly of the robot cleaner according to an exemplary embodiment, and FIG. 4 is a view illustrating a part of the pad assembly of the robot cleaner according to an exemplary embodiment.

Referring to FIGS. 3 and 4, the pad assembly 2 of the robot cleaner 1 includes a locking member 23 and a pad 25 that is configured to contact a floor. A structure of the first pad assembly 2*a* is explained. The structure of the second pad assembly 2*b*, the third pad assembly 2*c* and the fourth pad assembly 2*d* is similar to that of the first pad assembly 2*a*.

The locking member 23 may be accommodated in locking member accommodation parts 21 and 22. The locking member accommodation parts 21 and 22 may include a first locking member accommodation part 21 and a second locking member accommodation part 22. The locking member 23 may be accommodated in a space defined by the first locking member accommodation part 21 and the second locking member accommodation part 22. The first locking member accommodation part 21 and the second locking member accommodation part 22 may be coupled to each other, for example, by hooks.

The locking member 23 may be formed with locking holes 235, 236, 237 and 238 through which locking protrusions 241, 242, 243 and 244 formed at a pad mounting part 24 (that will be described later) are inserted. The locking protrusions 241, 242, 243 and 244 inserted through the locking holes 235, 236, 237 and 238 may interact with the locking member 23 around the locking holes 235, 236, 237 and 238. The locking holes 235, 236, 237 and 238 may be provided plural in number. For example, the locking holes 235, 236, 237 and 238 may include a first locking hole 235, a second locking hole 236, a third locking hole 237 and a fourth locking hole 238 that are spaced apart from each other with a predetermined interval therebetween.

The locking member accommodation parts 21 and 22 may be formed with holes corresponding to the first locking hole 235, the second locking hole 236, the third locking hole 237 and the fourth locking hole 238. The locking member 23 may be positioned such that a part of the holes 221, 222, 223 and 224 formed at the second locking member accommodation part 22 interferes with the locking member 23 formed with the locking holes 235, 236, 237 and 238. Accordingly, the locking protrusions 241, 242, 243 and 244 passing through the holes 221, 222, 223 and 224 formed at the second locking member accommodation part 22 may push the locking member 23 to the side.

A part of the locking member 23 may be cut off so that the locking member 23 has free ends. The free ends of the locking member 23 may be fixed to a portion of the locking member accommodation parts 21 and 22. For example, the free ends of the locking member 23 may be formed with holes, and protrusions provided at the second locking member accommodation part 22 are inserted through the holes of the free ends, thereby fixing the free ends of the locking member 23 to the locking member accommodation parts 21 and 22.

Due to the free ends 231, 232, 233 and 234, the locking member 23 may have elasticity in a direction parallel to one surface of the locking member 23. Therefore, when the locking protrusions 241, 242, 243 and 244 are inserted through the locking holes 235, 236, 237 and 238, the locking member 23 may be pushed to one side by the locking protrusions 241, 242, 243 and 244. After the locking protrusions 241, 242, 243 and 244 pass through the locking holes 235, 236, 237 and 238, the locking member 23 moves to the other side by elastic force and thus returns to the original position. When the locking member 23 returns to the original position, the locking member 23 may interact with the locking protrusions 241, 242, 243 and 244. Accordingly, the pad mounting part 24 is mounted to the bottom surface of the locking member accommodation parts 21 and 22 by the locking member 23.

The free ends 231, 232, 233 and 234 may be provided plural in number. For example, in a case wherein the locking holes 235, 236, 237 and 238 include a first locking hole 235, a second locking hole 236, a third locking hole 237 and a fourth locking hole 238 that are spaced apart from each other with a predetermined interval therebetween, the free ends 231, 232, 233 and 234 may include a first free end 231, a second free end 232, a third free end 233 and a fourth free end 234. The first locking hole 235 may be formed near the first free end 231. The second locking hole 236 may be formed near the second free end 232. The third locking hole 237 may be formed near the third free end 233. The fourth locking hole 238 may be formed near the fourth free end 234.

The pad mounting part 24 may be mounted to the bottom surface of the locking member accommodation parts 21 and 22. The pad mounting pad 24 may be provided with the locking protrusions 241, 242, 243 and 244 on one surface thereof. Each of the locking protrusions 241, 242, 243 and 244 may have a locking part that extends to the side from the top of each protrusion. While passing through the locking holes 221, 222, 223 and 224 of the second locking member accommodation part 22, the locking protrusions 241, 242, 243 and 244 may push the locking member 23 accommodated in the locking member accommodation parts 21 and 22 to one side. After the locking parts of the locking protrusions 241, 242, 243 and 244 pass through the locking member 23, the locking member 23 returns to the original position. If the locking member 23 returns to the original position, the locking parts interfere with the locking member 23. Accordingly, the pad mounting part 24 is mounted to the bottom surface of the second locking member accommodation part 22.

The pad 25 to clean a floor may be mounted to the pad mounting part 24. The pad 25 may be made of a fabric material. The pad 25 may be fixed to the pad mounting part 24 using, for example, Velcro. A coupling structure of the pad 25 and the pad mounting part 24 may be referred to as a pad unit.

The locking member accommodation parts 21 and 22, the locking member 23, the pad mounting part 24 and the pad 25 may be formed with holes 210, 220, 230, 240 and 250, respectively, that communicate with each other. Water contained in the water tank 101 may be supplied to the pad 25 through the holes 210, 220, 230, 240 and 250. The locking member 23 may be positioned such that the holes 210, 220, 240 and 250 of the locking member accommodation parts 21 and 22, the pad mounting part 24 and the pad 25 communicate with a part of the hole 230 of the locking member 23. In other words, the locking member 23 may be positioned such that a region of the locking member 23 around the hole 230 interferes with a part of the holes 210, 220, 240 and 250 of the locking member accommodation parts 21 and 22, the pad mounting part 24 and the pad 25.

Figure 5:
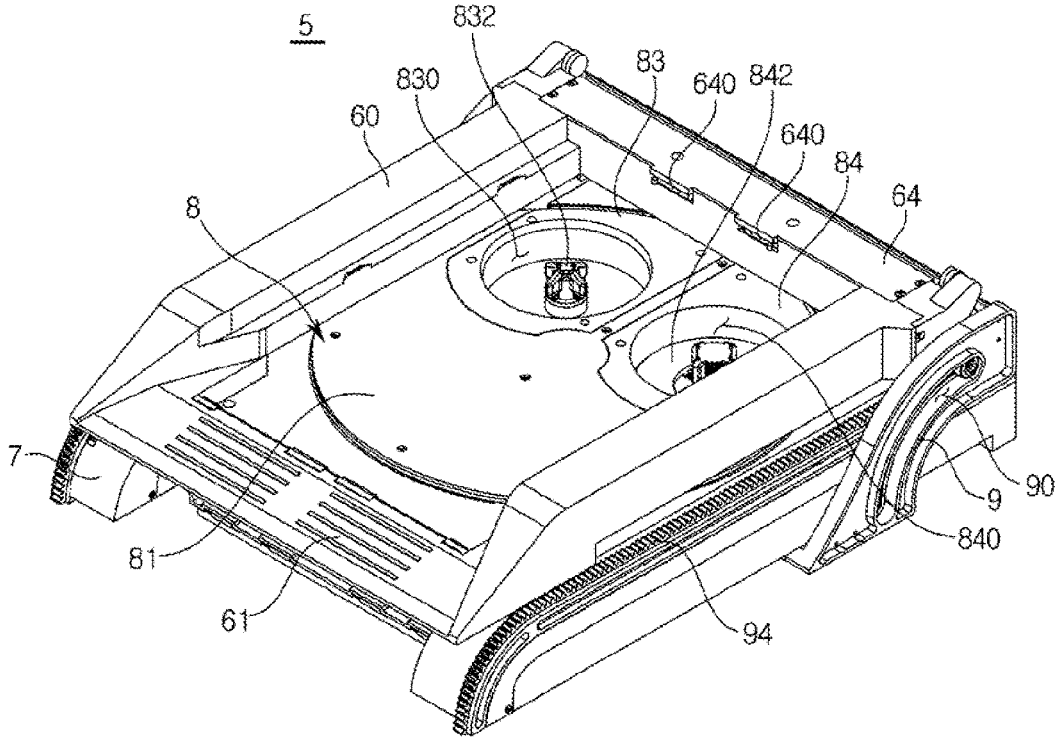
FIGS. 5 and 6 are views illustrating a pad changer according to an exemplary embodiment.
Figure 6:
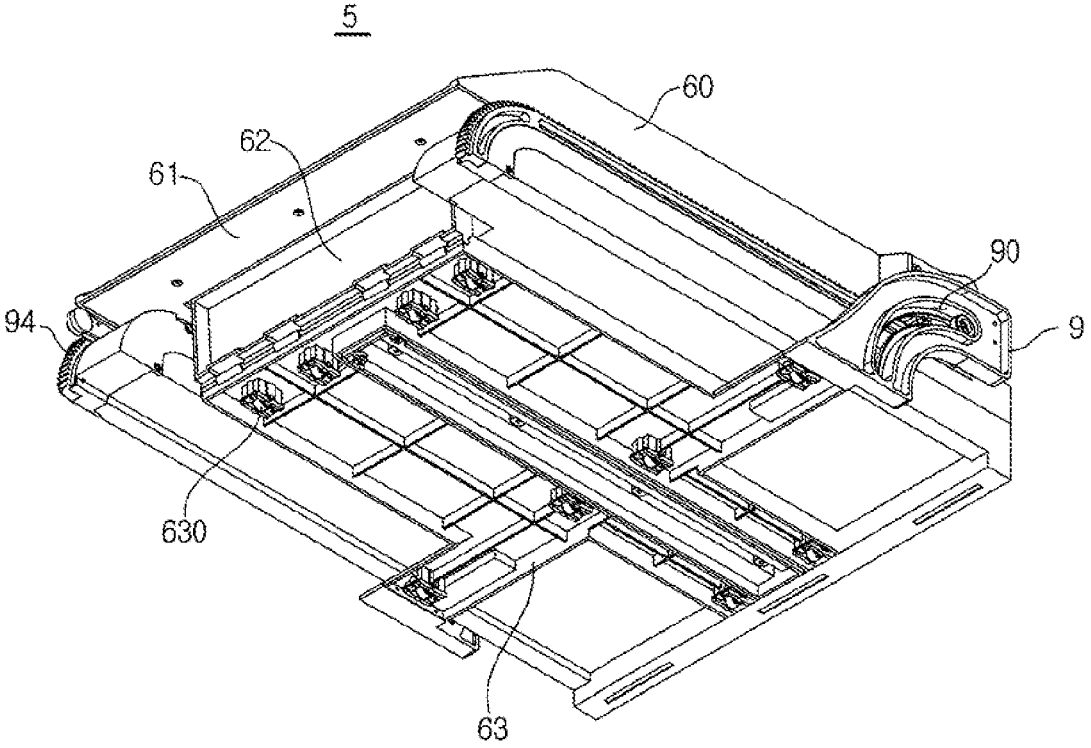
Figure 7:
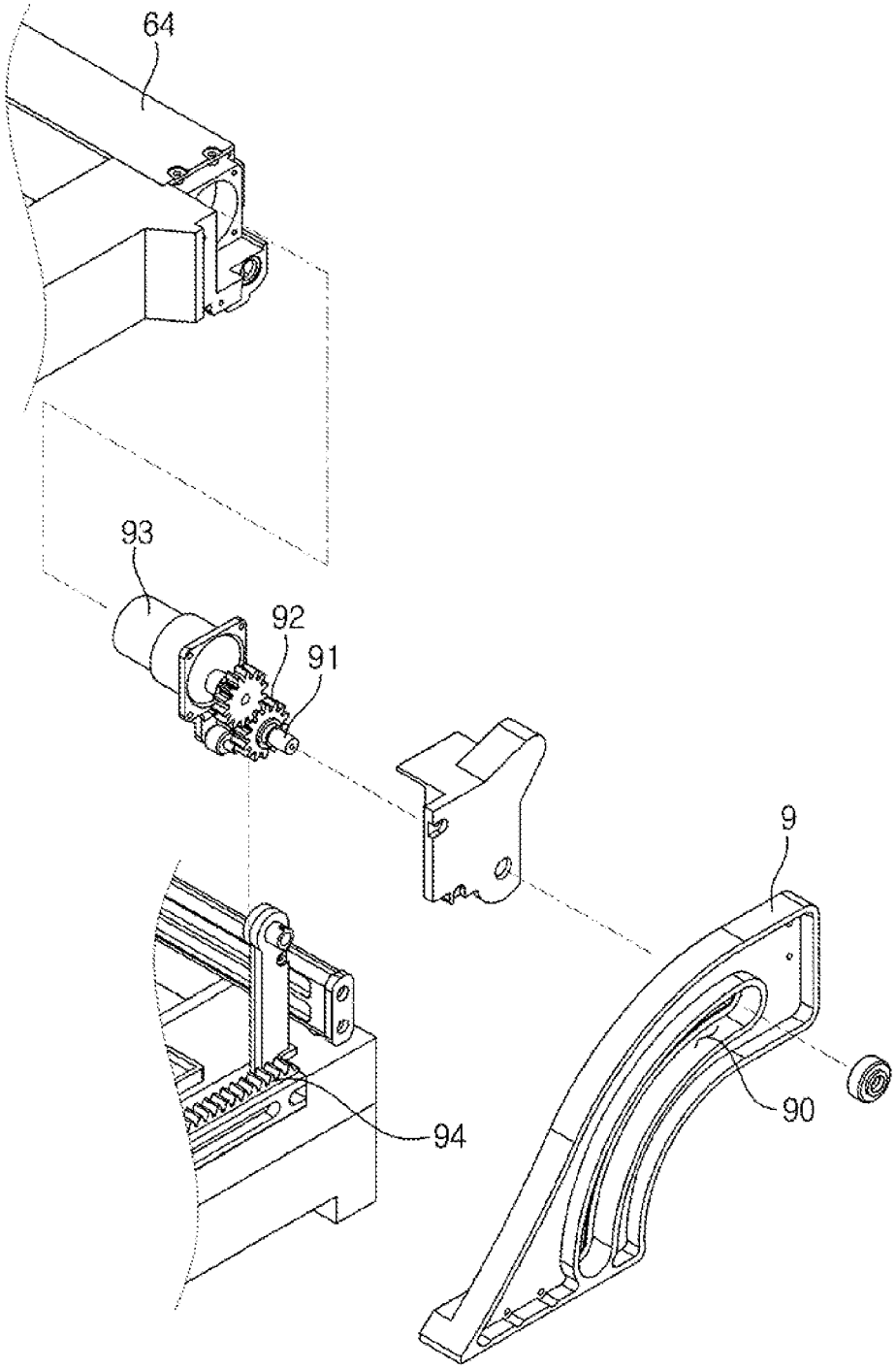
FIG. 7 is an exploded perspective view illustrating a guide part of the pad changer according to an exemplary embodiment.
Figure 8A:
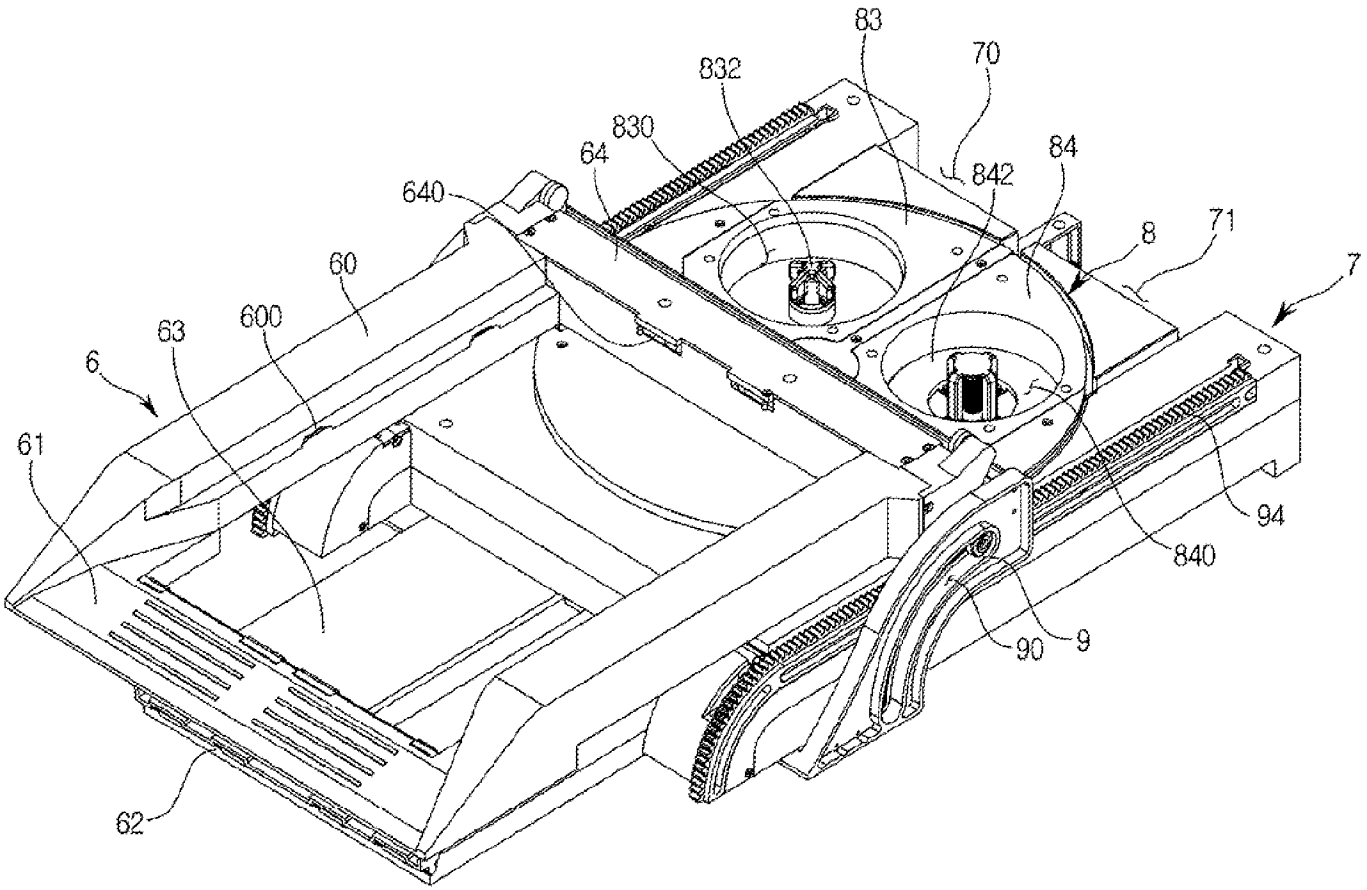
FIGS. 8A and 8B are views illustrating a state in which a plate unit of the pad changer according to an exemplary embodiment slides.
Figure 8B:
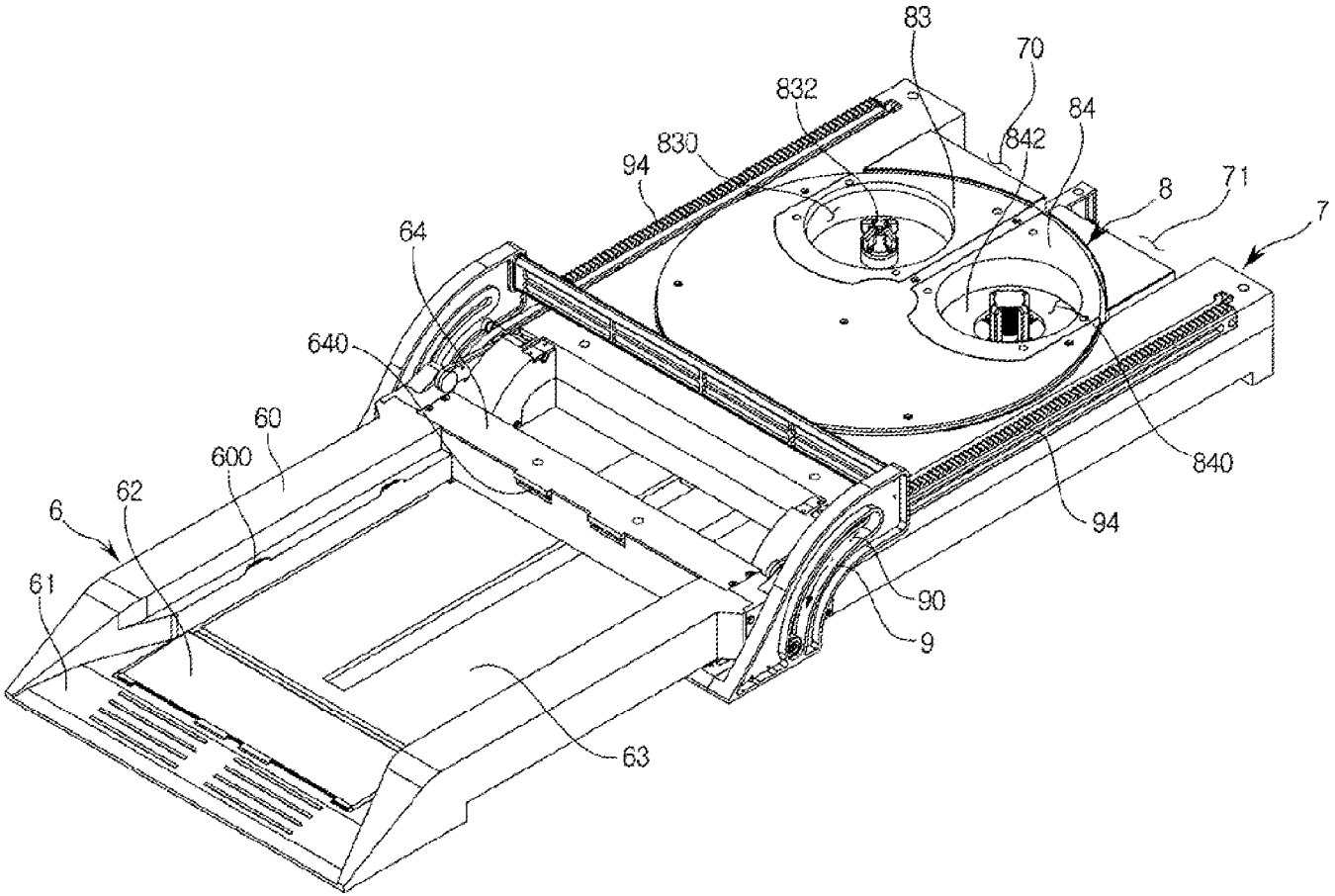
Figure 9:
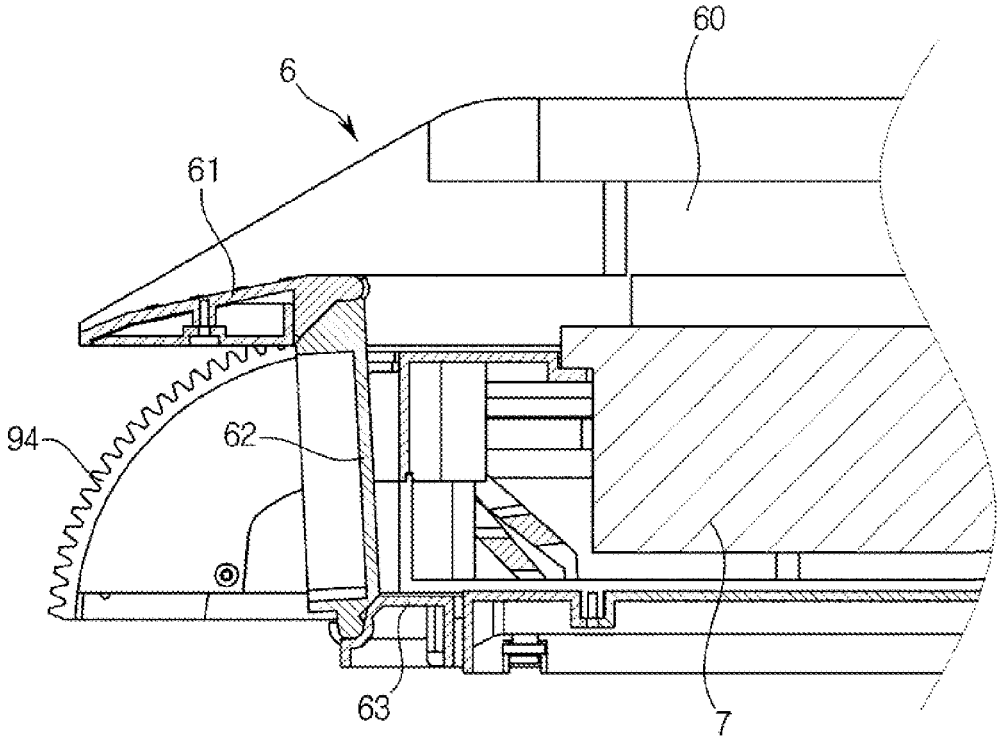
FIG. 9 is a sectional view illustrating a part of the plate unit of the pad changer according to an exemplary embodiment.

FIGS. 5 and 6 are views illustrating the pad changer according to the exemplary embodiment, FIG. 7 is an exploded perspective view illustrating a guide part of the pad changer according to the exemplary embodiment, FIGS. 8A and 8B are views illustrating a state in which the plate unit of the pad changer slides, and FIG. 9 is a sectional view illustrating a part of the plate unit of the pad changer according to the exemplary embodiment.

Referring to FIGS. 5 through 8B, the pad changer 5 includes the plate unit 6, the case 7 and the replacement unit 8. The plate unit 6 may be positioned, for example, on the case 7 or in front of the case 7. The replacement unit 8 may be received in the case 7. When there is a need to replace a contaminated pad of the robot cleaner 1, the plate unit 6 may move, for example, slide to the front of the case 7.

The plate unit 6 may include a frame, a first plate 61, a second plate 62 and a third plate 63. The frame may include side frames 60 provided at left and right sides of the plate unit 6, and a rear frame 64 provided at a rear portion of the plate unit 6. The frame may be connected to the first plate 61 or may be provided integrally with the first plate 61. The first plate 61 may be positioned in front of the side frames 60. The first plate 61 is an area that the robot cleaner 1 first approaches. In order for the robot cleaner 1 to easily enter the plate unit 6, the first plate 61 may be slanted such that the height of the first plate 61 from a floor increases rearward.

The second plate 62 may connect the first plate 61 and the third plate 63. The second plate 62 may be pivotably connected to the first plate 61 and the third plate 63. For example, one portion of the second plate 62 may be hinged to the first plate 61, and the other portion of the second plate 62 may be hinged to the third plate 63.

When the frame and the first plate 61 are positioned on the case 7, the second plate 62 may be positioned such that one surface of the second plate 62 opposes a front surface of the case 7. The second plate 62 may form a predetermined angle with the first plate 61 and the third plate 63. When the frame and the first plate 61 slide to the front of the case 7, the second plate 62 may rotate about a hinge shaft and thus, may lie in the same plane as the third plate 63.

The third plate 63 may be positioned under the case 7 or in front of the case 7. When the frame and the first plate 61 are positioned on the case 7, the third plate 63 may be positioned under the case 7. When the frame and the first plate 61 slide and are positioned in front of the case 7, the third plate 63 may also slide together with the frame and the first plate 61 and may be positioned in front of the case 7. Wheels 630 may be provided at the bottom surface of the third plate 63. The third plate 63 may easily slide, for example, by virtue of the wheels 630.

The frame and the third plate 63 may be connected by the connection unit 9. The connection unit 9 may be connected to the side frames 60 or the rear frame 64. An exemplary structure wherein the connection unit 9 is connected to the rear frame 64 is explained.

Rack gears 94 may be provided at the side surfaces of the case 7. The frame may be provided with pinion gears 92 configured to move along the rack gears 94. A shaft 91 and a motor 93 may be connected to each of the pinion gears 92. The pinion gear 92 may move forward or backward along the rack gear 94 by the motor 93. The shaft 91 connected to the pinion gear 92 may move forward or backward with the pinion gear 92.

The connection unit 9 may be formed with a guide slot 90 into which the shaft 91 is inserted. The guide slot 90 may be formed to have a predetermined curvature. The guide slot 90 may extend from a front lower portion of the connection unit 9 to a rear upper portion of the connection unit 9. If the pinion gear 92 moves forward or rearward along the rack gear 94, an inner surface of the guide slot 90 interferes with the shaft 91 and thus the connection unit 9 may move forward or rearward with the shaft 91. If the connection unit 9 moves forward or rearward, the plate unit 6 connected to the connection unit 9 may move forward or rearward with the connection unit 9.

A front portion of the rack gear 94 provided at the case 7 may have a shape corresponding to the shape of the guide slot 90. Accordingly, the shaft 91 connected to the pinion gear 92 may move to the end of the guide slot 90 that is positioned at a front lower portion of the connection unit 9. As a result, the plate unit 6 may be seated on a floor.

FIGS. 10A through 10E are views illustrating a state in which the robot cleaner according to the exemplary embodiment is seated on the pad changer.

Referring to FIGS. 10A through 10E, if replacement of the pad 25 of the robot cleaner 1 is not necessary, the frame of the pad changer 5 may be positioned on the case 7. The pinion gear 92 and the shaft 91 may be positioned at a rear portion of the rack gear 94. Such a state may be referred to as an initial position of the plate unit 6.

Figure 10A:
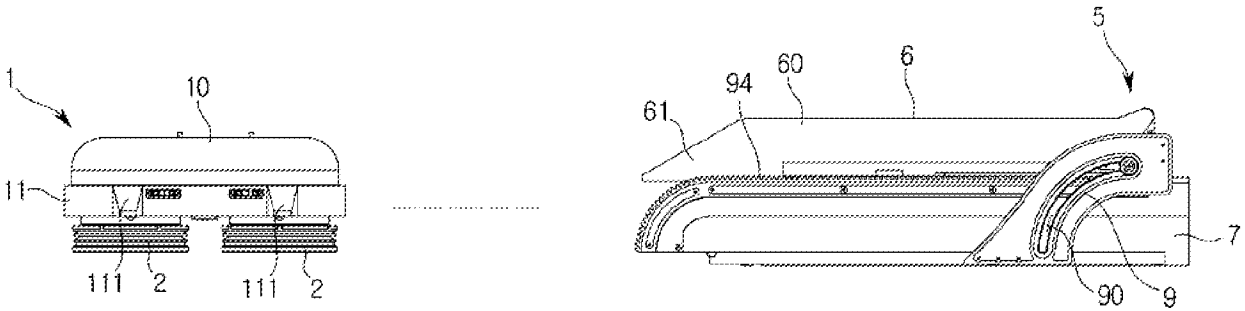
FIGS. 10A through 10E are views illustrating a state in which the robot cleaner according to an exemplary embodiment is seated on the pad changer.
Figure 10B:
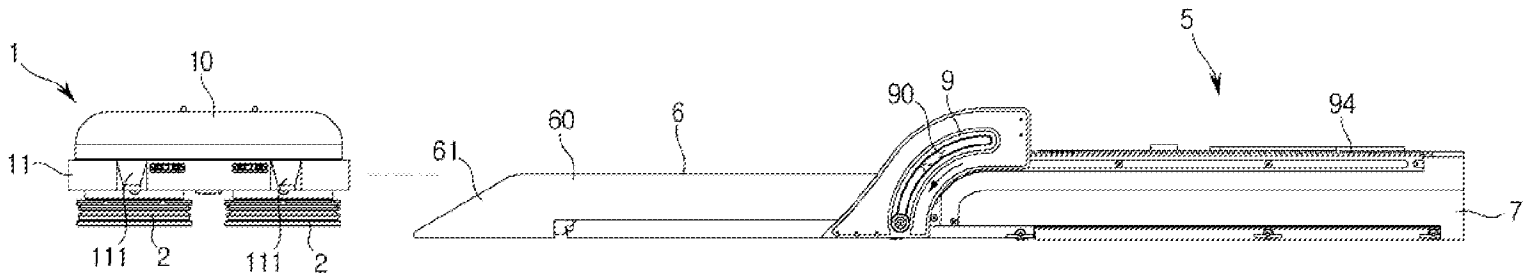
Figure 10C:
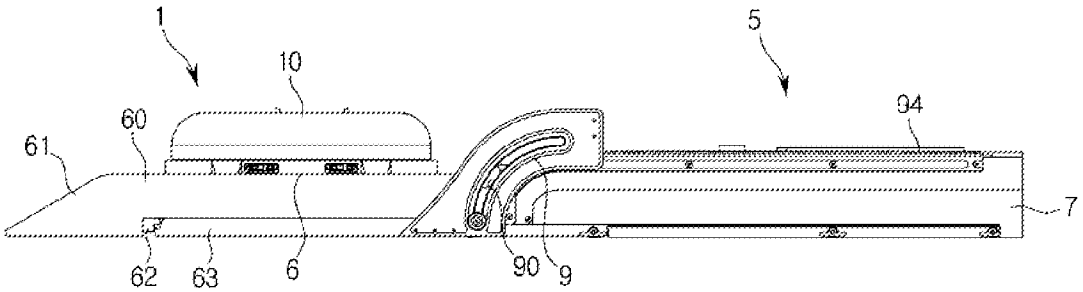
Figure 10D:
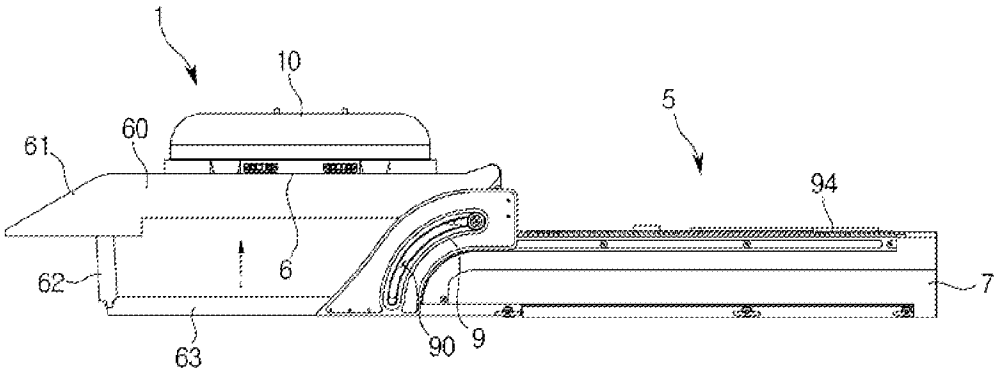
Figure 10E:
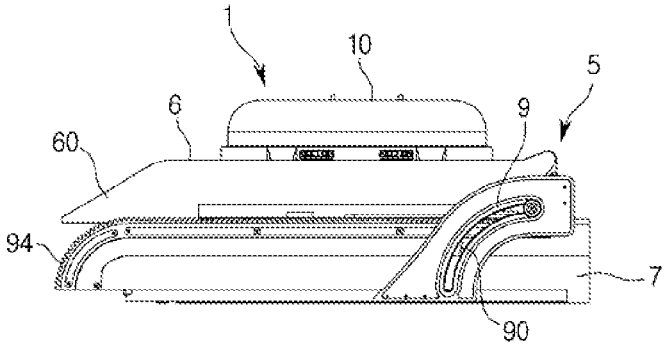

If there is a need to replace a contaminated pad of the robot cleaner 1, as illustrated in FIG. 10B, the plate unit 6 of the pad changer 5 may slide and may be positioned in front of the case 7. If the pinion gear 92 moves forward along the rack gear 94 while rotating by the motor 93, the connection unit 9 moves forward by the shaft 91. The plate unit 6 connected to the connection unit 9 also moves forward together. The shaft 91 moves along the guide slot 90 formed at the connection unit 9, by which the plate unit 6 is seated on a floor. The second plate 62 may rotate about the hinge shaft and may lie in the same plane as the third plate 63.

If the plate unit 6 of the pad changer 5 is positioned in front of the case 7, the robot cleaner 1 may move to the plate unit 6 and may be seated on the third plate 63. The robot cleaner 1 may easily move to the top surface of the plate unit 6 via the slanted first plate 61.

If the robot cleaner 1 is seated on the top surface of the third plate 63, the pinion gear 92 may rotate by the motor 93 and may move to a rear upper portion of the guide slot 90 along the shape of the guide slot 90. The first plate 61 may move to the rear upper portion of the guide slot 90 together with the pinion gear 92 and the shaft 91. The third plate 63 is kept seated on a floor and the second plate 62 rotates about the hinge shaft and forms a predetermined angle with the first plate 61 and the third plate 63. The fixing protrusions 600 provided at the side frames 60 are coupled to the guide protruding parts 111 provided at the side surfaces of the robot cleaner 1, thereby lifting the robot cleaner 1 from the third plate 63.

If the pinion gear 92 moves rearward along the rack gear 94, the shaft 91 may also move rearward. The shaft 91 may move rearward while pushing the inner surface of the rear upper portion of the guide slot 90 formed at the connection unit 9. The connection unit 9 may move rearward by the shaft 91. The plate unit 6 may move rearward together with the connection unit 9. The robot cleaner 1 seated on the plate unit 6 may also move rearward and may reach the top surface of the replacement unit 8 received in the case 7.

If the robot cleaner 1 is positioned on the replacement unit 8, the contaminated pad 25 provided at the bottom surface of the robot cleaner 1 may be replaced with a new pad by the replacement unit 8. After replacement is finished, the pinion gear 92 may move along the rack gear 94 so that the plate unit 6 is seated on a floor. The robot cleaner 1 may escape from the plate unit 6 to clean a floor. After the robot cleaner 1 exits from the plate unit 6, the pinion gear 92 moves along the rack gear 94 so that the plate unit 6 returns to the initial position.

Figure 11:
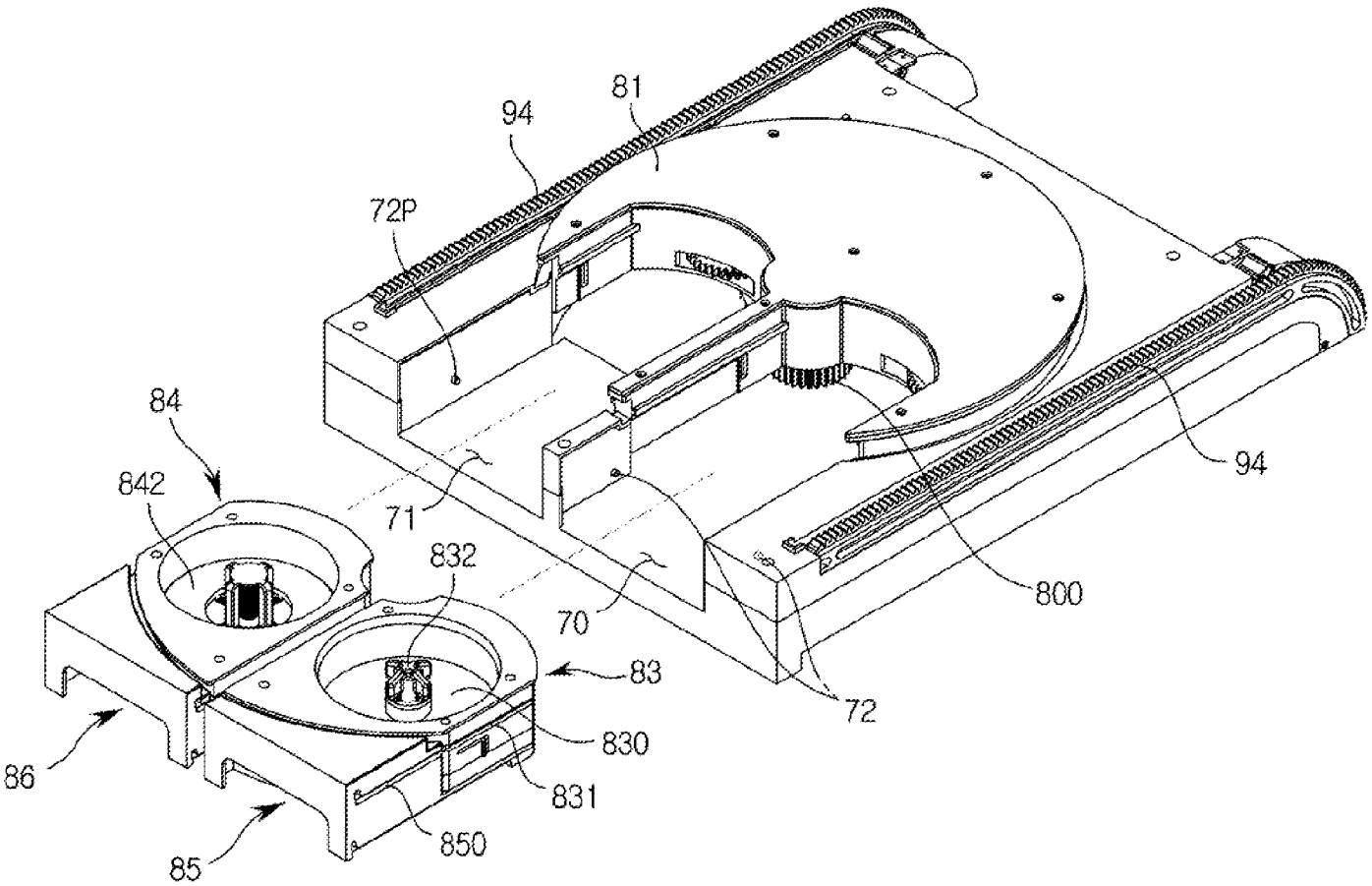
FIG. 11 is an exploded perspective view illustrating the pad changer according to an exemplary embodiment with the plate unit removed therefrom.

FIG. 11 is an exploded perspective view illustrating the pad changer according to the exemplary embodiment with the plate unit removed therefrom.

Referring to FIG. 11, the replacement unit 8 may be received in the case 7. The replacement unit 8 may include a separation cartridge 83 and a mounting cartridge 84.

The replacement unit 8 may include a base 80 that has a circular shape. The separation cartridge 83 and the mounting cartridge 84 may be received in the base 80. The separation cartridge 83 may be formed with a pad unit receiving part 830 in which the pad unit to which a contaminated pad is mounted is received. The mounting cartridge 84 may be formed with a pad unit receiving part 840 in which the pad unit to which a new pad is mounted is received.

A cover 81 may be disposed on the replacement unit 8. A part of the cover 81 positioned on the separation cartridge 83 and the mounting cartridge 84 may be opened. The cover 81 may rotate with the case 80.

The case 7 may be formed with openings 70 and 71 at a side surface thereof, through which the separation cartridge 83 and the mounting cartridge 84 are inserted. The separation cartridge 83 and the mounting cartridge 84 inserted through the openings 70 and 71 may be seated on the circle-shaped base 80. If the separation cartridge 83 and the mounting cartridge 84 are totally inserted, a front outer surface of the separation cartridge 83 and a front outer surface of the mounting cartridge 84 may lie in the same plane as an outer surface of the base 80, or may be positioned in the rear of the outer surface of the base 80. If the base 80 rotates, the separation cartridge 83 and the mounting cartridge 84 may rotate with the base 80.

The separation cartridge 83 may be seated on a separation holder 85. The separation holder 85 and the separation cartridge 83 may be inserted into the case 7 through the opening 70. If the separation cartridge 83 and the separation holder 85 are inserted together into the case 7, the separation cartridge 83 may be seated on the base 80.

The separation cartridge 83 may be formed with guide recesses 831 at a side surface thereof, and the separation holder 85 may be formed with guide recesses 850 at a side surface thereof. The guide recesses 831 and 850 are extended in a forward and backward direction. A front portion of each guide recess 850 may be bent upward. The case 7 may be provided with guide protrusions 72 at an inner side surface thereof, that are inserted into the guide recesses 831 and 850. By insertion of the guide protrusions 72 into the guide recesses 831 and 850, the separation holder 85 and the separation cartridge 83 may be securely introduced into the case 7. Since the separation holder 85 is held by the guide protrusions 72, when the separation cartridge 83 seated on the base 80 rotates with the base 80, the separation holder 85 may be prevented from rotating.

The mounting cartridge 84 may be seated on a mounting holder 86. The mounting holder 86 and the mounting cartridge 84 may be inserted into the case 7 through the opening 71. If the mounting cartridge 84 and the mounting holder 86 are inserted together into the case 7, the mounting cartridge 84 may be seated on the base 80.

The mounting cartridge 84 and the mounting holder 86 may be formed with guide recesses (not illustrated) at side surfaces thereof. The guide recesses may be extended in a forward and backward direction. A front portion of the guide recess may be bent upward. The case 7 may be provided with guide protrusions 72P at an inner side surface thereof, which are inserted into the guide recesses. By insertion of the guide protrusions 72P into the guide recesses, the mounting holder 86 and the mounting cartridge 84 may be securely introduced into the case 7. Since the mounting holder 86 is held by the guide protrusions 72P, when the mounting cartridge 84 seated on the base 80 rotates with the base 80, the mounting holder 86 may be prevented from rotating.

Figure 12:
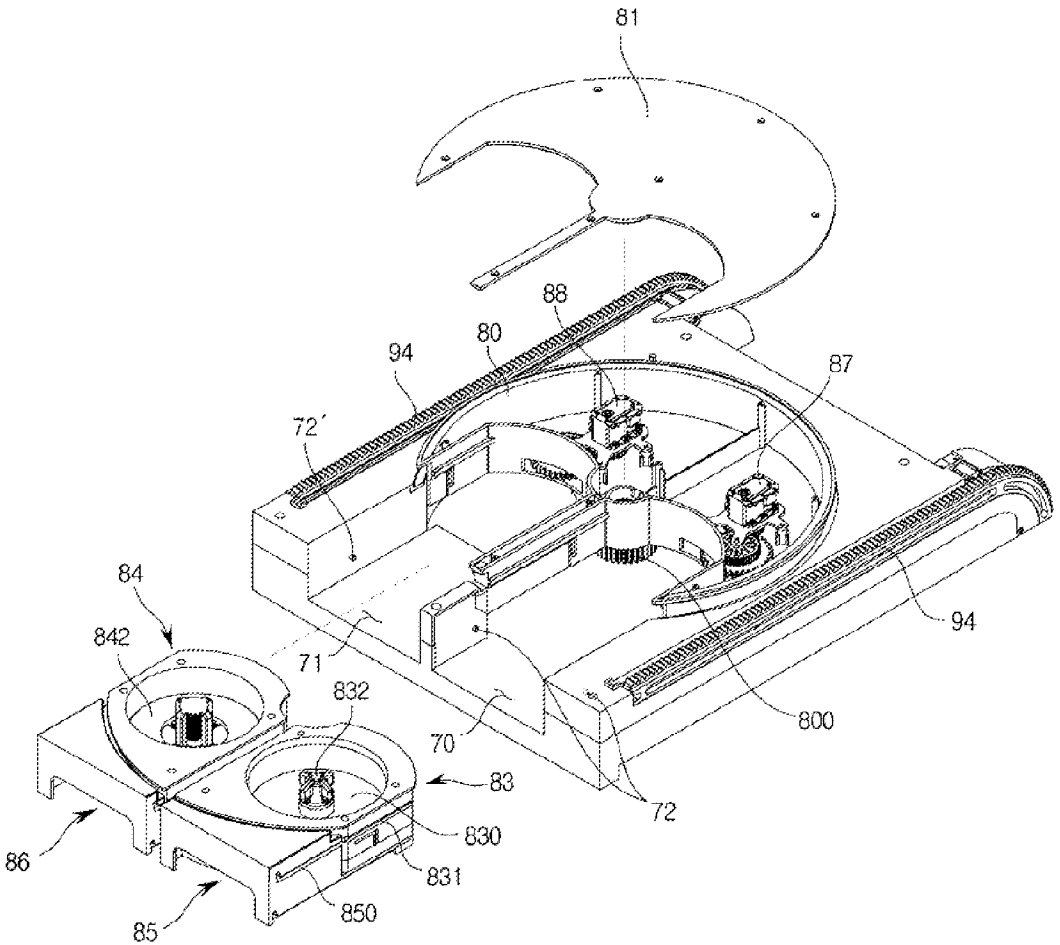
FIG. 12 is a view illustrating the pad changer according to an exemplary embodiment with a cover of a replacement unit removed therefrom.
Figure 13:
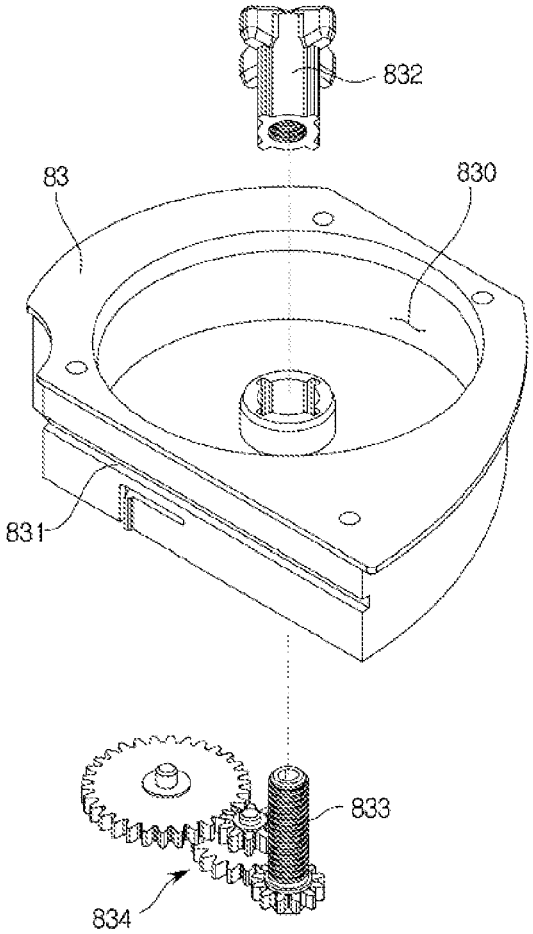
FIG. 13 is an exploded perspective view illustrating a separation cartridge according to an exemplary embodiment.
Figure 14:
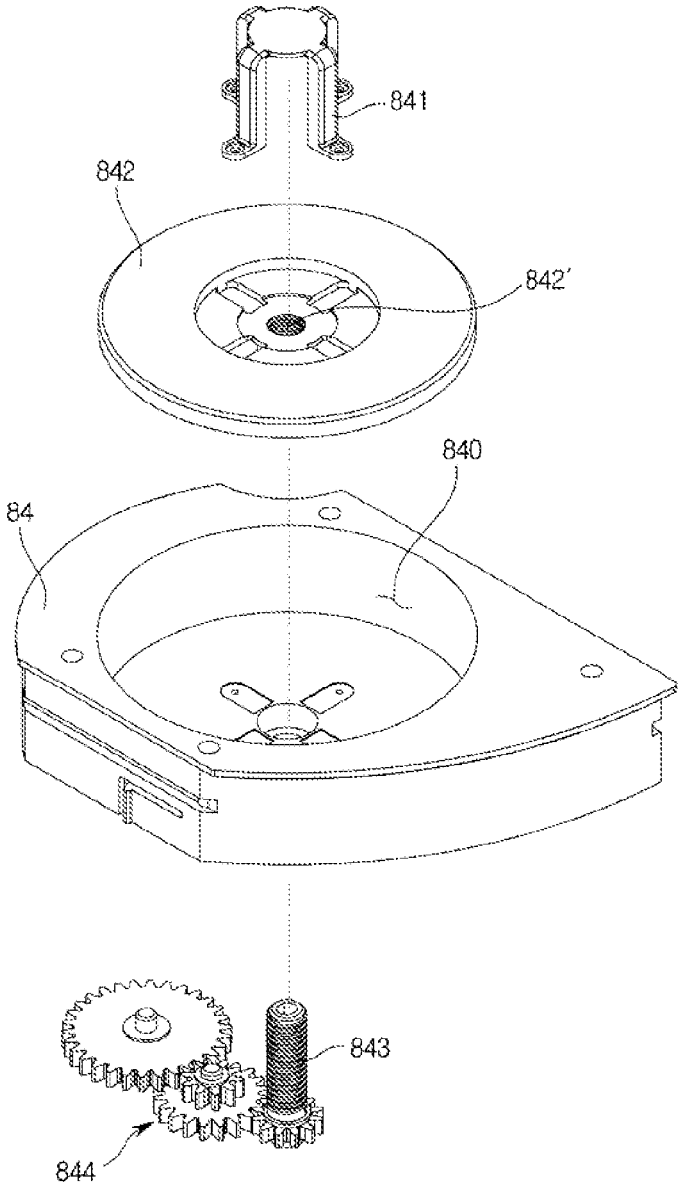
FIG. 14 is an exploded perspective view illustrating a mounting cartridge according to an exemplary embodiment.
Figure 15:
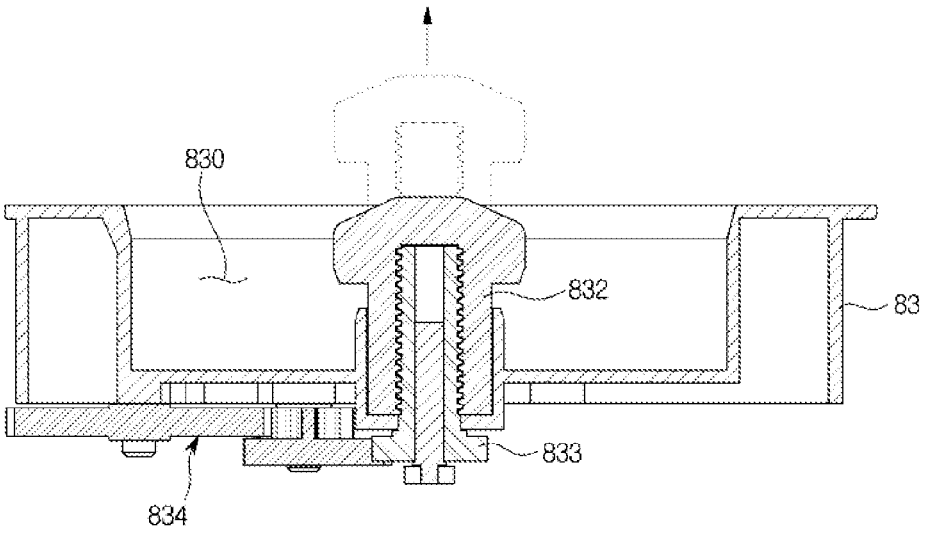
FIG. 15 is a sectional view of the separation cartridge according to an exemplary embodiment.
Figure 16:
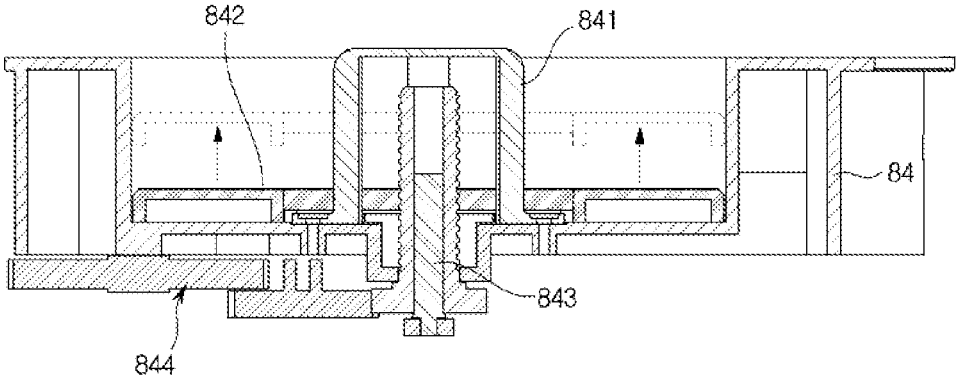
FIG. 16 is a sectional view of the mounting cartridge according to an exemplary embodiment.
Figure 17:
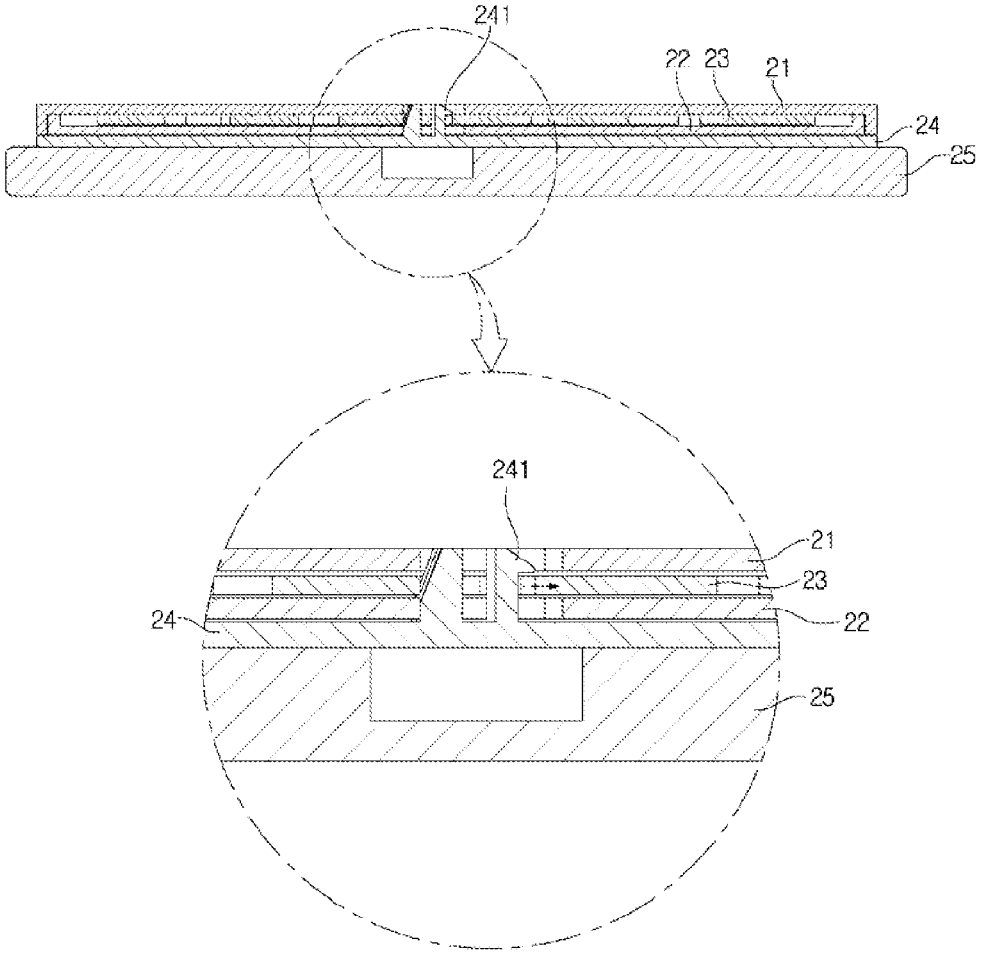
FIG. 17 is a view illustrating a locking release state of the pad assembly according to an exemplary embodiment.

FIG. 12 is a view illustrating the pad changer according to the exemplary embodiment with the cover of the replacement unit removed therefrom, FIG. 13 is an exploded perspective view illustrating the separation cartridge, FIG. 14 is an exploded perspective view illustrating the mounting cartridge, FIG. 15 is a sectional view of the separation cartridge, FIG. 16 is a sectional view of the mounting cartridge, and FIG. 17 is a view illustrating a locking release state of the pad assembly according to the exemplary embodiment.

Referring to FIGS. 12 through 17, a rotation part 833 provided with threads on an outer surface thereof may be disposed at a lower portion of the separation cartridge 83. The rotation part 833 may be disposed in the pad unit receiving part 830 of the separation cartridge 83. The rotation part 833 may be arranged to extend upward from the bottom of the separation cartridge 83.

A separation device 832 may be coupled to the rotation part 833. The separation device 832 may be provided with threads on an inner surface thereof, which correspond to the threads on the outer surface of the rotation part 833. When the rotation part 833 rotates, as illustrated in FIG. 13, since the separation device 832 is prevented from rotating, the separation device 832 may move up and down in a longitudinal direction of the rotation part 833.

A gear part 834 may be connected to the rotation part 833. A part of the separation cartridge 83 may be cut off so that the gear part 834 is connected to a motor 87 to receive driving force from the motor 87. The gear part 834 may be connected to a gear coupled to the motor 87. The gear part 834 may rotate by receiving driving force from the motor 87 provided in the case 7. The rotation part 833 may rotate by the gear part 834. If the rotation part 833 rotates, the separation device 832 may move up and down.

If the robot cleaner 1 is placed on the replacement unit 8 and the separation device 832 moves upward, the pad unit having the contaminated pad may be separated. The separation device 832 may apply a pressure to the holes 210, 220, 230, 240 and 250 of the pad assembly. The separation device 832 moving upward may push the locking member 23 interfering with the holes 210, 220, 230, 240 and 250 to the side. The locking member 23 may be pushed to the side and may move upward by a predetermined distance. Accordingly, the locking state between the locking member 23 and the locking protrusions 241, 242, 243 and 244 formed at the pad mounting part 24 may be released. By the release of the locking state by the locking member 23, the pad mounting part 24 may be separated from the first pad assembly 2*a*. Accordingly, the pad unit having the contaminated pad may be separated from the first pad assembly 2*a*. The separated pad unit may be received in the pad unit receiving part 830 formed at the separation cartridge 83.

A rotation part 843 provided with threads on an outer surface thereof may be disposed at a lower portion of the mounting cartridge 84. The rotation part 843 may be disposed in the pad unit receiving part 840 of the mounting cartridge 84. The rotation part 843 may be arranged to extend upward from the bottom of the mounting cartridge 84.

A mounting plate 842 may be mounted to the rotation part 843. The mounting plate 842 may be formed with a mounting hole 842P, and the rotation part 843 may be inserted through the mounting hole 842P. The mounting hole 842P may be provided with threads on an inner surface thereof, which correspond to the threads on the outer surface of the rotation part 843.

A gear part 844 may be connected to the rotation part 843. A part of the mounting cartridge 84 may be cut off so that the gear part 844 is connected to a motor 88 to receive driving force from the motor 88. The gear part 844 may be connected to a gear coupled to the motor 88. The gear part 844 may rotate by receiving driving force from the motor 88 provided in the case 7. The rotation part 843 may rotate by the gear part 844. If the rotation part 843 rotates, the mounting plate 842 may move up and down along the rotation part 843 by a rotation prevention member 841 illustrated in FIG. 14.

A new pad unit may be seated on the mounting plate 842. If the mounting plate 842 moves upward, the new pad unit may be mounted to a position of the first pad assembly 2*a* from which the contaminated pad unit is separated. If the mounting plate 842 moves upward, the locking protrusions 241, 242, 243 and 244 formed at the pad mounting part 24 may be inserted through the holes 221, 222, 223 and 224 formed at the second locking member accommodation part 22 and may push the locking member 23 interfering with the holes 221, 222, 223 and 224 to the side. If the mounting plate 842 moves upward further and the locking protrusions 241, 242, 243 and 244 pass through the locking member 23, the locking parts extending to the side from the tops of the locking protrusions 241, 242, 243 and 244 interfere with the locking member 23 and thus the pad mounting part 24 may be mounted to the bottom surface of the locking member accommodation parts 21 and 22. Accordingly, the new pad unit may be mounted to the first pad assembly 2*a*.

Figure 18:
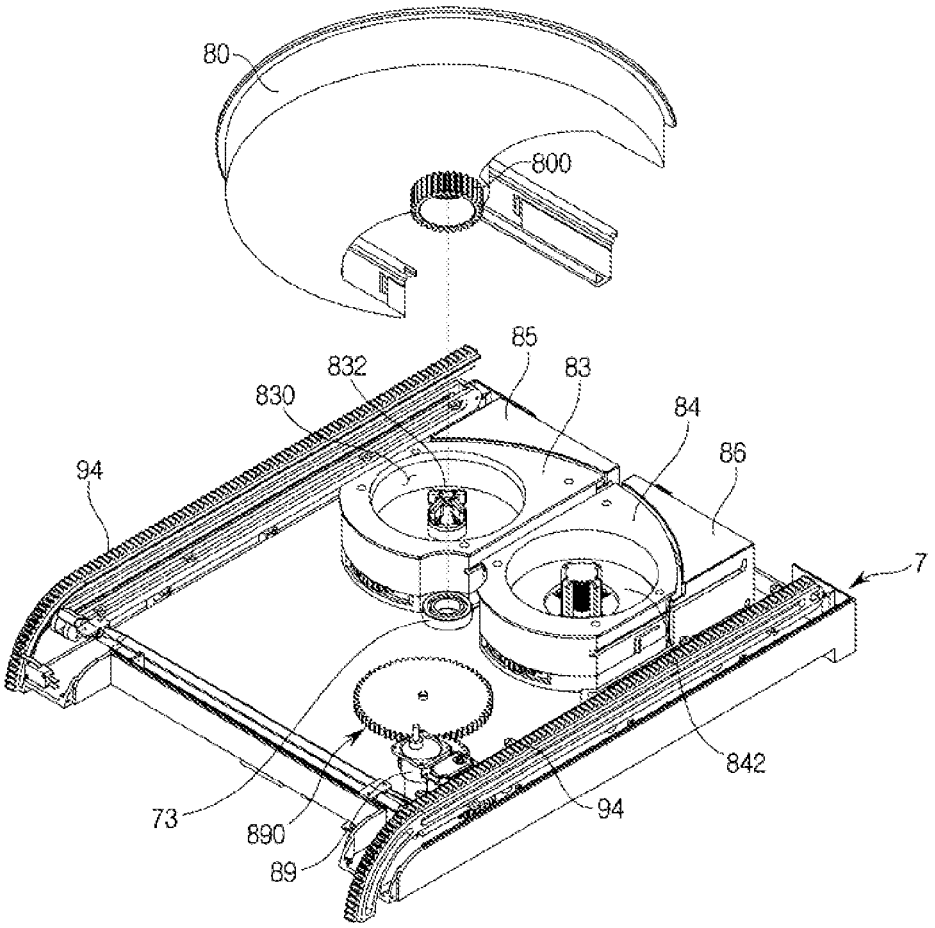
FIG. 18 is a view illustrating a driving unit to rotate the replacement unit according to an exemplary embodiment.

FIG. 18 is a view illustrating a driving unit to rotate the replacement unit according to an exemplary embodiment.

Referring to FIG. 18, the base 80 may rotate by a motor 89 provided in the case 7. A gear part 800 may be protrudingly provided at the bottom surface of the base 80. The gear part 800 may be formed integrally with the base 80 or may be fixed to the bottom surface of the base 80 so as to rotate with the base 80. The gear part 800 may be formed with a hole 801. The case 7 may be provided with a fixing part 73 at an inner surface thereof which is inserted into the hole 801. By insertion of the fixing part 73 into the hole 801, the position of the base 80 in the case 7 may be fixed.

The motor 89 provided in the case 7 may be configured to drive the base 80. The motor 89 and the gear part 800 provided at the bottom surface of the base 80 may be connected by plural gears 890. If the motor 89 is driven, the plural gears 890 rotate and the gear part 800 tooth-engaged with at least one of the plural gears 890 may also rotate. Accordingly, the base 80 having the gear part 800 may rotate clockwise or counterclockwise about the fixing part 73.

If the robot cleaner 1 is placed on the replacement unit 8 and the contaminated pad unit is separated by the separation cartridge 83, the base 80 may rotate clockwise or counterclockwise by the motor 89. If the first pad assembly 2*a* from which the contaminated pad unit is separated is placed on the mounting cartridge 84, operation of the motor 89 may be stopped and thus rotation of the base 80 may be stopped. A new pad unit received in the mounting cartridge 84 may be mounted to the bottom surface of the first pad assembly 2*a*. Accordingly, the contaminated pad unit may be removed, and a new pad unit may be mounted to the first pad assembly 2*a*.

By rotation of the base 80 clockwise or counterclockwise, pad units, for example, all of the contaminated pad units mounted to the pad assembly 2 provided at the robot cleaner 1 may be replaced with new pad units.

Figure 19:
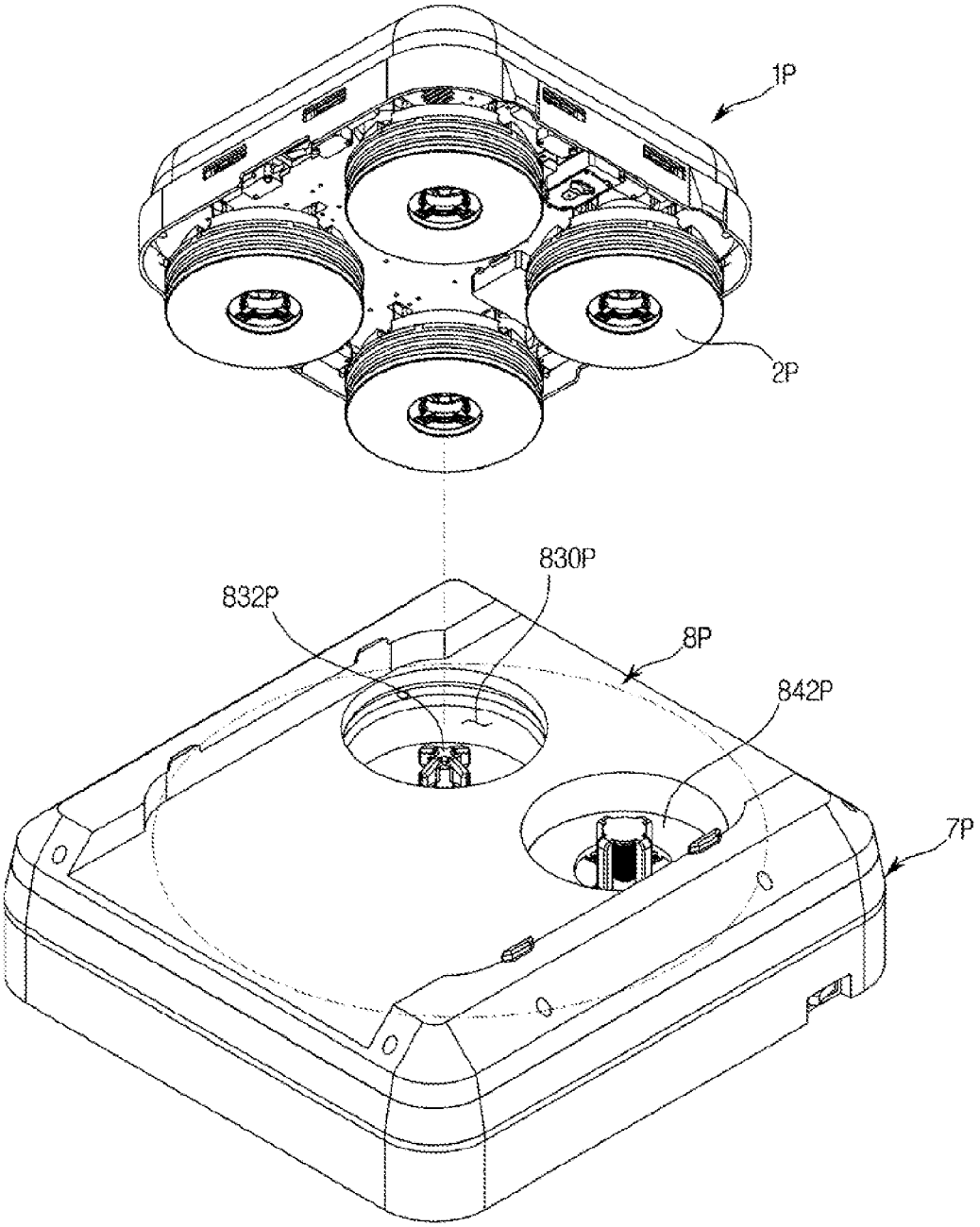
FIG. 19 is a view illustrating a robot cleaner system according to an exemplary embodiment.

FIG. 19 is a view illustrating a robot cleaner system according to an exemplary embodiment.

Referring to FIG. 19, a robot cleaner system according to an exemplary embodiment may include a robot cleaner 1P, a case 7P, a replacement unit 8P, a pad unit receiving part 830P, a separation device 832P, and a mounting plate 842P. An exemplary structure and operation of the robot cleaner 1P and the replacement unit 8P are similar to that of the robot cleaner 1 and the replacement unit 8 according to an exemplary embodiment described above. However, the robot cleaner system according to this embodiment does not include the plate unit 6 and the connection unit 9 of the robot cleaner system according to the previous embodiment. Therefore, if there is a need to replace a contaminated pad of the robot cleaner 1P, a user may manually place the robot cleaner 1P on the replacement unit 8P. If the robot cleaner 1P is placed on the replacement unit 8P, the contaminated pad unit of the robot cleaner 1P may be separated by the replacement unit 8P and a new pad unit may be mounted to the robot cleaner 1P.

As described above, since a contaminated pad mounted to the robot cleaner may be automatically replaced with a new pad, problems generated when a user manually removes a contaminated pad, for example, drop of contaminants on a floor or adherence of contaminants to a user's hand, may be prevented. An accident of dropping the robot cleaner by mistake when a user manually removes a contaminated pad may be prevented. Since a user can collect the pad units piled in the separation cartridge 83 all at once and separate the pads from the pad mounting parts to wash or discard the pads, convenience in use may be enhanced. In addition, in a case wherein the robot cleaner system is controlled to automatically replace contaminated pads with new pads at a regular time interval, a floor may be cleaned by clean pads and accordingly, cleaning efficiency may be enhanced.

Although a few embodiments have been illustrated and described, it would be appreciated by those skilled in the art that changes may be made in these embodiments without departing from the principles and spirit of the invention, the scope of that is defined in the claims and their equivalents.

What is claimed is:

1. A pad changer to replace a pad mounted to a cleaner, comprising:

a replacement unit including a separation cartridge to separate the pad from the cleaner and receive the separated pad therein, and a mounting cartridge to receive a pad therein and mount the pad to the cleaner, and a case, wherein the replacement unit further includes a base configured to rotate with respect to the case, on which the separation cartridge and the mounting cartridge are seated.

2. The pad changer according to claim 1, wherein the separation cartridge includes a pad separation device configured to move up and down in the separation cartridge and separate the pad from the cleaner.

3. The pad changer according to claim 1, wherein the mounting cartridge includes a mounting plate on which the pad is seated and that is configured to move up and down in the mounting cartridge.

4. The pad changer according to claim 1, wherein the case is formed with an opening at a portion thereof, through which the separation cartridge and the mounting cartridge are inserted into the case.

5. The pad changer according to claim 4, wherein the separation cartridge is seated on a separation holder to be inserted into the case, and the mounting cartridge is seated on a mounting holder to be inserted into the case.

6. The pad changer according to claim 4, wherein the opening of the case is provided with a guide protrusion at an inner side surface thereof, and the separation cartridge or the mounting cartridge is formed with a guide recess that extends in a forward and backward direction and into which the guide protrusion is inserted.

7. The pad changer according to claim 1, further comprising:

a plate unit on which the cleaner is seated and that is configured to move between the front of the case and a portion of the case corresponding to a position of the replacement unit.

8. The pad changer according to claim 7, wherein the plate unit includes a frame, a first plate, a second plate and a third plate, and wherein the first plate, the second plate and the third plate are connected to the frame.

9. The pad changer according to claim 8, wherein the frame is provided with fixing protrusions to support the cleaner.

10. The pad changer according to claim 8, wherein the case is provided with a rack gear, and the plate unit is provided with a pinion gear tooth-engaged with the rack gear.

11. The pad changer according to claim 10, further comprising:

a connection unit that is connected to the third plate and is formed with a guide slot into which a rotating shaft of the pinion gear is inserted.

12. The pad changer according to claim 11, wherein the guide slot is formed in a gradual curve.

13. A cleaner system comprising a cleaner having a pad assembly and a pad changer to replace a pad mounted to the pad assembly, wherein the pad assembly includes a pad unit and a locking member to which the pad unit is coupled, the pad changer includes a replacement unit including a separation cartridge to separate the pad unit from the locking member and receive the separated pad unit therein and a mounting cartridge to receive a pad unit therein and mount the pad unit to the locking member, wherein the pad unit includes a pad and a pad mounting part, the pad being removably mounted to a bottom surface of the pad mounting part, and the pad mounting part is provided with locking protrusions that have locking parts formed at tops thereof.

14. The cleaner system according to claim 13, wherein the pad assembly further includes locking member accommodation parts to accommodate the locking member therein, and the locking member has free ends, by which the locking member is elastically deformed.

15. The cleaner system according to claim 14, wherein the locking member and the locking member accommodation parts are formed with locking holes through which the locking protrusions are inserted, and the locking holes of the locking member accommodation parts partially interfere with the locking member.

16. The cleaner system according to claim 15, wherein the separation cartridge includes a separation device configured to move up and down in the separation cartridge, and wherein the separation device pushes the locking member upward to release interference of the locking protrusions with the locking member.

17. The cleaner system according to claim 15, wherein the mounting cartridge includes a mounting plate on which the pad unit is seated and that is configured to move up and down in the mounting cartridge, and wherein the mounting plate moves upward so that the locking protrusions of the pad unit interfere with the locking member, thereby mounting the pad unit to the locking member.

18. A cleaner system comprising a cleaner having a pad assembly and a pad changer to replace a pad mounted to the pad assembly, wherein the pad assembly includes a pad unit and a locking member to which the pad unit is coupled, the pad changer includes a replacement unit including a separation cartridge to separate the pad unit from the locking member and receive the separated pad unit therein and a mounting cartridge to receive a pad unit therein and mount the pad unit to the locking member, the pad changer further includes a plate unit to support the cleaner above the replacement unit, and the cleaner is provided with guide protruding parts at side surfaces thereof, and the plate unit is provided with fixing protrusions to support the guide protruding parts of the cleaner.

19. The cleaner system according to claim 18, wherein the pad changer further includes a case to receive the replacement unit therein, and wherein the plate unit is configured to move between the front of the case and a portion of the case corresponding to a position of the replacement unit.

* * * * *